US005569146A

United States Patent [19]

Simmons

[11] Patent Number: 5,569,146

[45] Date of Patent: Oct. 29, 1996

[54] CUSHIONING CONVERSION MACHINE INCLUDING A CUTTING/ALIGNING ASSEMBLY

[75] Inventor: James A. Simmons, Painesville Township, Ohio

[73] Assignee: Ranpak Corp., Concord Township, Ohio

[21] Appl. No.: 188,305

[22] Filed: Jan. 28, 1994

[51] Int. Cl.[6] ..... B65H 35/06

[52] U.S. Cl. ..... 493/352; 493/372; 493/464; 493/967; 83/157; 83/734

[58] Field of Search ..... 493/352, 372, 493/464, 967; 83/157, 734

[56] References Cited

U.S. PATENT DOCUMENTS

| | | | |
|---|---|---|---|
| 1,509,835 | 9/1924 | Grossenbach . | |
| 1,958,132 | 5/1934 | Davis . | |
| 2,101,170 | 12/1937 | Engel . | |
| 2,882,802 | 4/1959 | Walker . | |
| 2,973,678 | 3/1961 | Scott et al. . | |
| 3,260,145 | 7/1966 | Giordano . | |
| 3,695,133 | 10/1972 | Finke . | |
| 3,757,621 | 9/1973 | Breetvelt | 83/157 |
| 3,779,116 | 12/1973 | Curtis | 83/157 |
| 3,842,699 | 10/1974 | Van Zyl . | |
| 3,924,504 | 12/1975 | Kurtz . | |
| 4,579,027 | 4/1986 | Lewis . | |
| 5,088,370 | 2/1992 | Kondo . | |
| 5,123,889 | 6/1992 | Armington | 493/352 |

FOREIGN PATENT DOCUMENTS

| | | |
|---|---|---|
| 0523382 | 1/1993 | European Pat. Off. . |
| PCTUS9217372 | 10/1992 | WIPO . |

*Primary Examiner*—Jack W. Lavinder
*Attorney, Agent, or Firm*—Renner, Otto, Boiselle & Sklar

[57] ABSTRACT

A cushioning conversion machine, which converts stock material into cut sections of dunnage, includes a cutting/aligning assembly. The cutting/aligning assembly comprises a moving blade unit which is mounted on the frame in such a manner that it travels between a rest position and a cutting position whereat it cuts a dunnage strip (which is emerging from a dunnage outlet opening) into a cut section. The cutting/aligning assembly also includes an automatic alignment device which automatically aligns the cut section with the dunnage outlet opening when the blade unit is moved from the cutting position to the rest position. The automatic alignment device is unattached to the moving blade member but travels therewith during jam-free operation of the cushioning conversion machine.

20 Claims, 10 Drawing Sheets

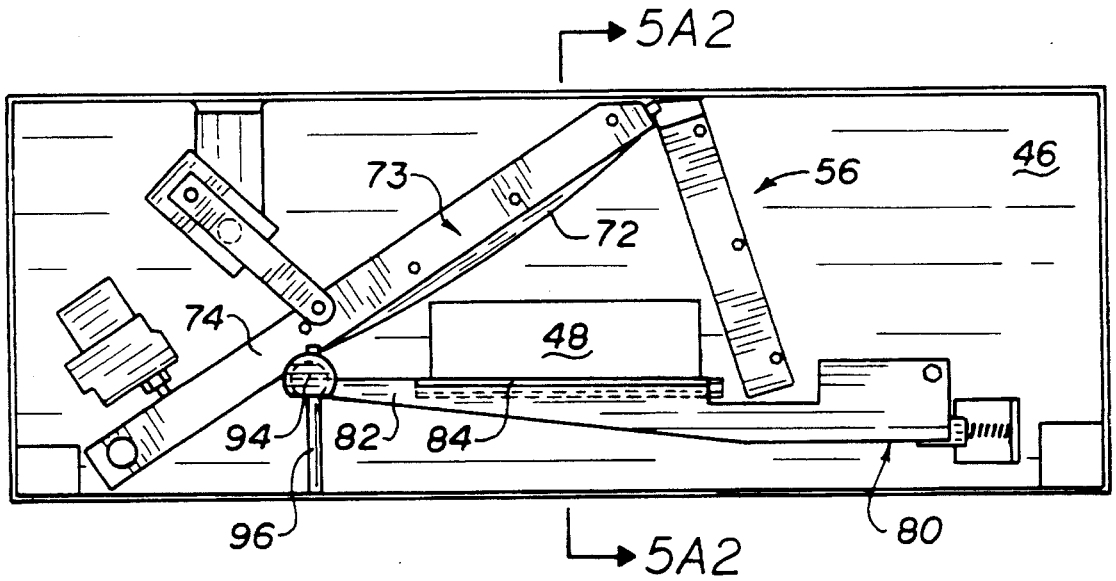
FIG. 5A1
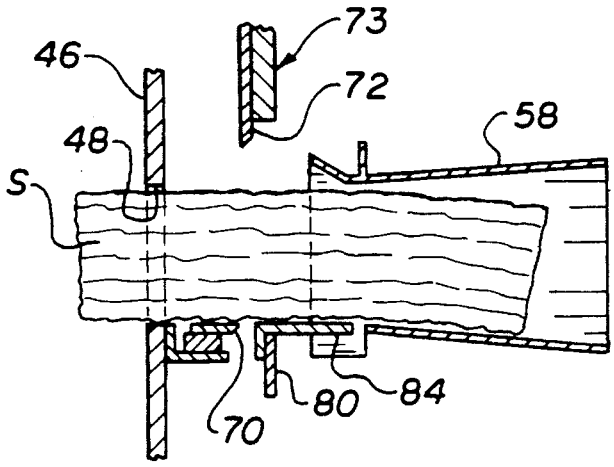
FIG. 5A2

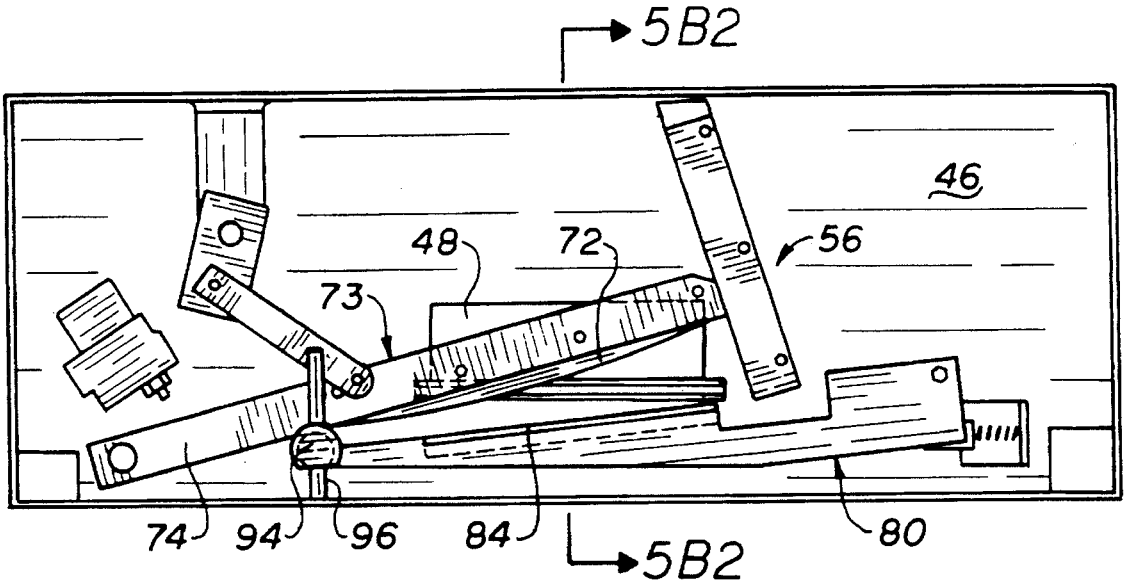
FIG. 5B1
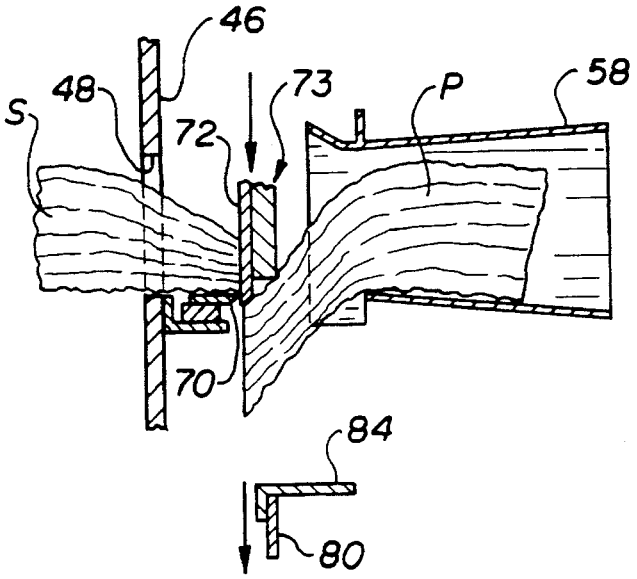
FIG. 5B2

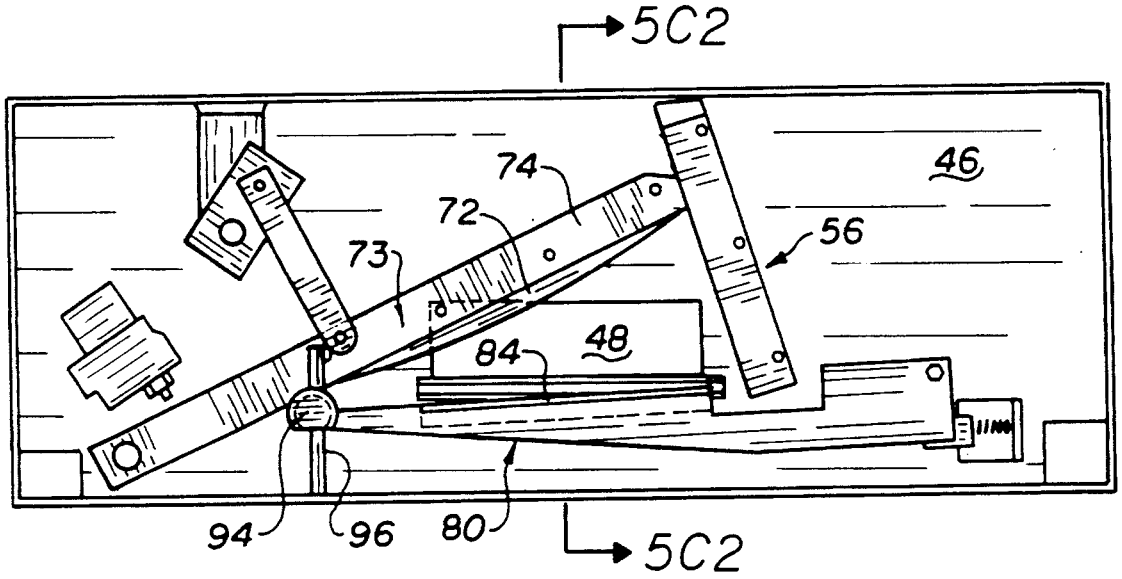
FIG. 5C1
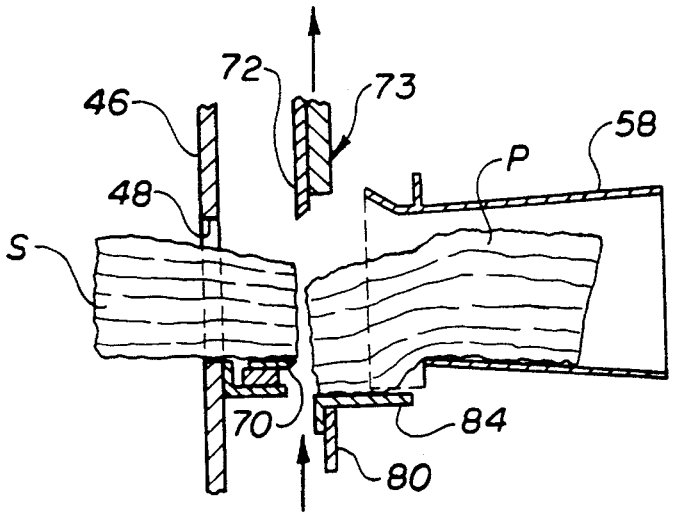
FIG. 5C2

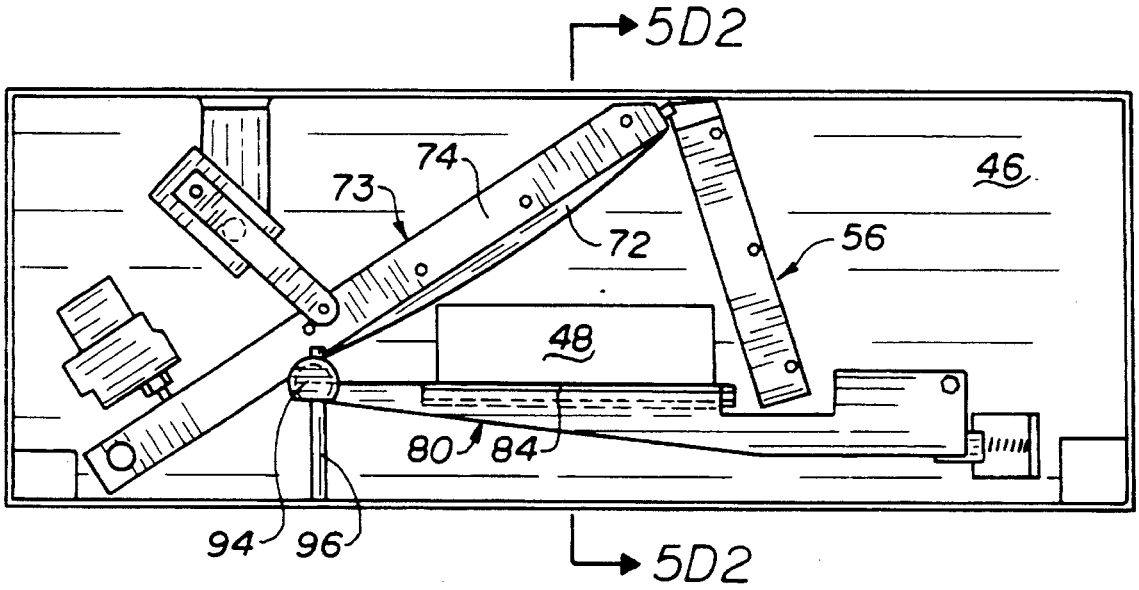
FIG. 5D1
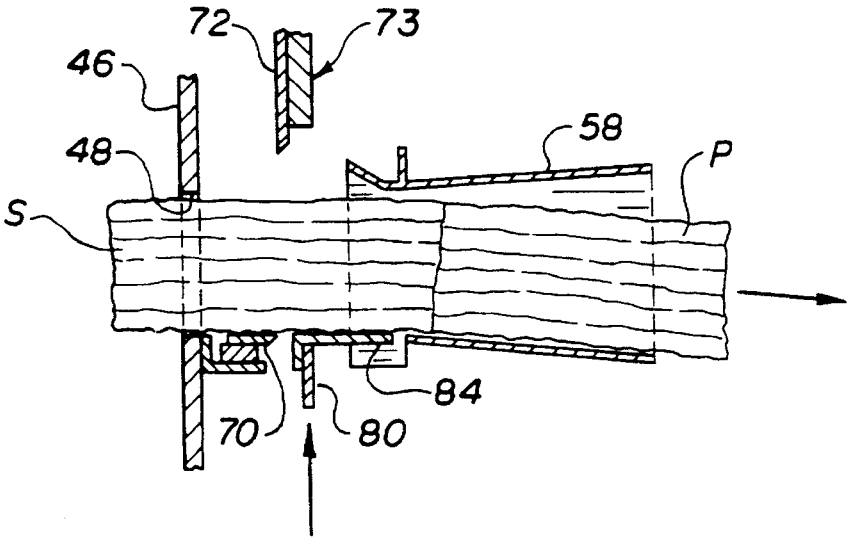
FIG. 5D2

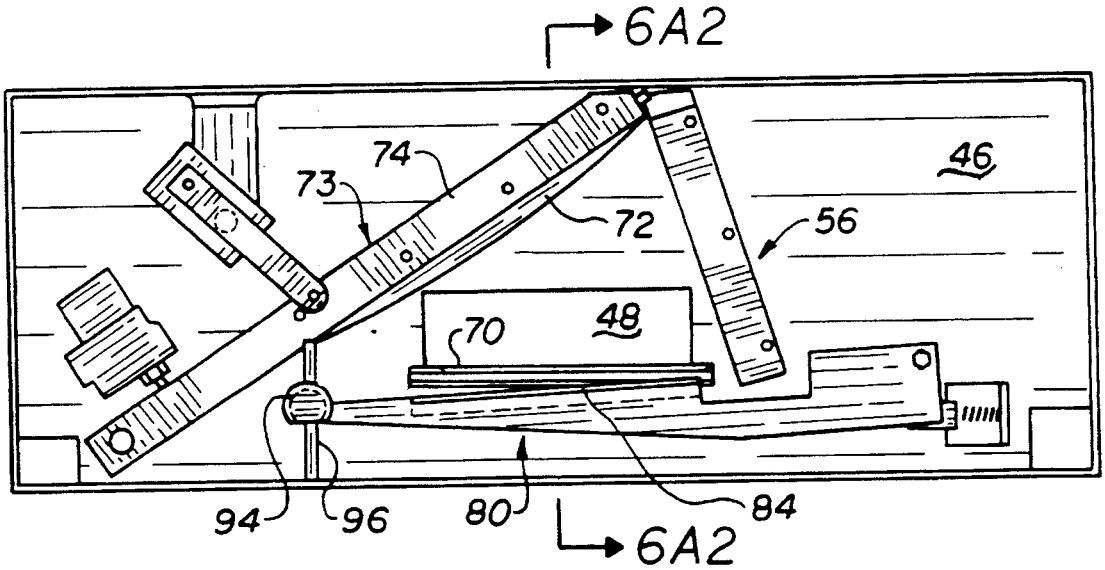
FIG. 6A1
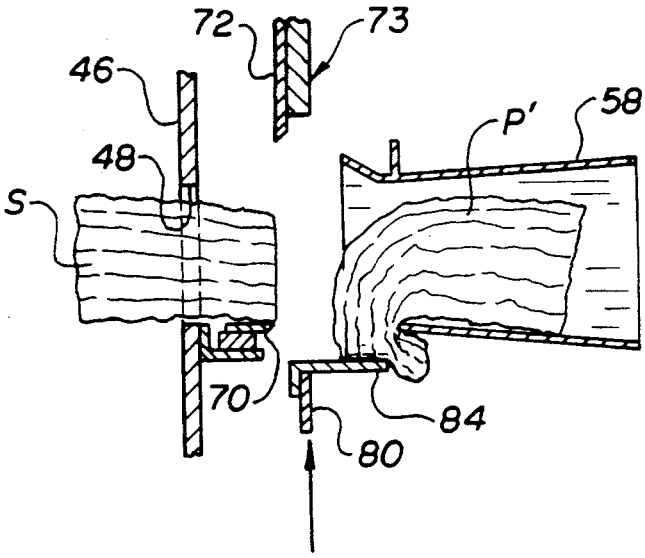
FIG. 6A2

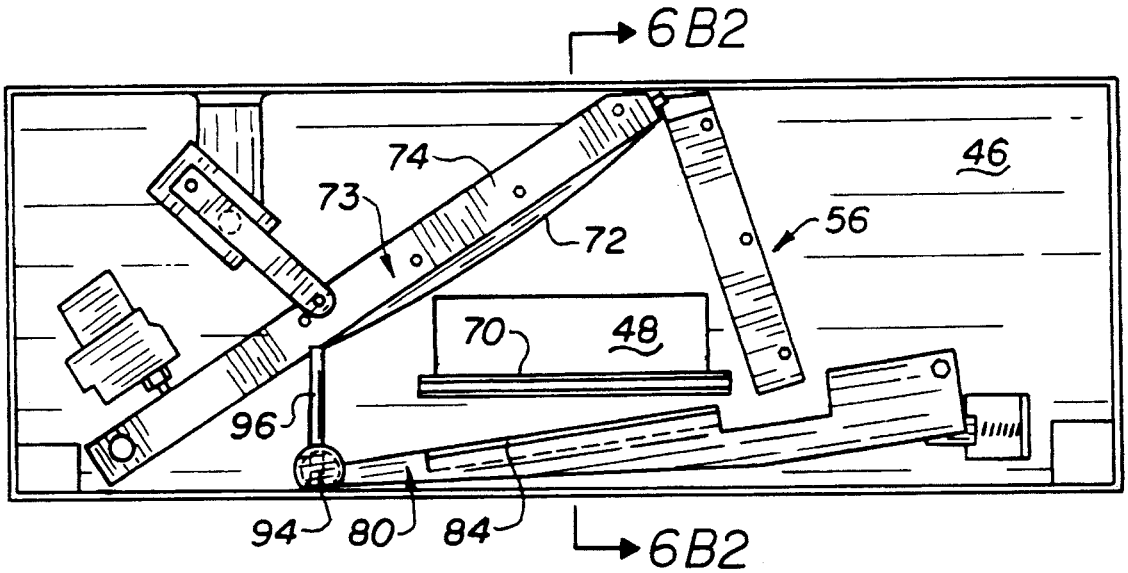
FIG. 6B1
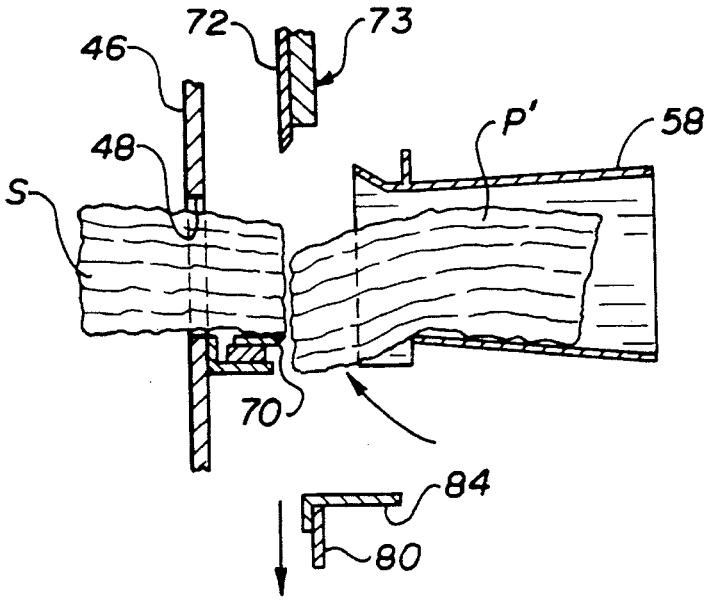
FIG. 6B2

CUSHIONING CONVERSION MACHINE INCLUDING A CUTTING/ALIGNING ASSEMBLY

FIELD OF THE INVENTION

This invention relates to a cushioning conversion machine including a cutting/aligning assembly which insures correct alignment of a cut section of dunnage relative to other key components of the machine.

BACKGROUND AND SUMMARY OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

This and other disadvantages of conventional plastic packaging materials have made paper protective packaging material a very popular alterative. Paper is biodegradable, recyclable and renewable, making it an environmentally responsible choice for conscientious industries.

While paper in sheet form could possibly be used as a protective packaging material, it is usually preferable to convert the sheets of paper into a pad-like dunnage product. This conversion may be accomplished by a cushioning conversion machine, such as that disclosed in U.S. application Ser. Nos. 07/840,306; 07/712,203 (now U.S. Pat. No. 5,123,889); and 07/592,572. (These applications are all assigned to the assignee of the present invention and their entire disclosures are hereby incorporated by reference.) Such a cushioning conversion machine converts sheet-like stock material, such as paper in multi-ply form, into cut sections of dunnage. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

The cushioning conversion machine disclosed in the above-identified applications includes a frame, and conversion assemblies which convert the stock material into a dunnage strip. A cutting assembly cuts the dunnage strip into sections of a desired length. The cushioning conversion machine further includes a post-cutting constraining assembly which is of particular interest in the present application. The post-cutting constraining assembly is located downstream of the cutting assembly and is positioned so that a cut section will be urged or pushed therethrough by the approaching dunnage strip. As the cut section passes through the post-cutting constraining assembly, it is constrained circumferentially to improve its cushioning quality.

The post-cutting constraining assembly has proven to be a very advantageous feature in a cushioning conversion machine. However, in order to be effective, the cross-sectional geometry of the post-cutting constraining assembly must closely approximate that of a cut section. Moreover, as was explained above, it is the urging of the approaching dunnage strip which pushes the cut section through the post-cutting constraining assembly. Consequently, it is important for the cut section to be aligned both with the outlet of the downstream end plate and the inlet of the post-cutting constraining assembly. In other words, the cut section must have a smooth transition into the post-cutting constraining assembly.

In the above-identified applications, the cutting assembly includes a moving blade unit which travels between a rest position and a cutting position. More specifically, the blade will travel through one cycle of making a cutting stroke and a return stroke to the rest position. During the cutting stroke, the moving blade unit travels across the dunnage outlet opening and cuts the dunnage strip into a cut section, or pad, of a desired length.

Applicant believes that the cutting assemblies disclosed in the above-identified applications adequately perform their cutting functions. Nonetheless, applicant also appreciated that, in certain situations, alignment problems might be created due to the action of the moving blade unit. Specifically, the action of the moving blade unit during the cutting stroke sometimes tends to misalign the cut section relative to the outlet opening and/or the inlet to the post-cutting constraining assembly. As the moving blade unit returns to the rest position, the cut section will sometimes "rebound" back into alignment. However, the cut section sometimes remains at least partially misaligned even after the return stroke.

Accordingly, applicant developed the cutting/aligning assembly of the present invention to insure correct-alignment of the cut section relative to the outlet of the end plate and the inlet of the post-cutting constraining assembly. Specifically, the cutting/aligning assembly includes an automatic alignment device which automatically "re-aligns" the cut section with the outlet opening and the post-cutting constraining assembly during the return stroke of the moving blade unit. In other words, the alignment device insures a smooth transition for the cut section from the outlet opening through the post-cutting constraining assembly. In this manner, the cut section steadily continues its downstream travel as it is pushed by the approaching dunnage strip.

Applicant further appreciated the importance of accommodating a serious jam situation (i.e., when a pad somehow becomes positioned in such a manner that it causes substantial interference with the operation of the machine). Although serious jams are extremely rare with the preferred cushioning conversion machine, they often result in mechanical damage. Applicant also appreciated the importance of being able to conveniently correct a serious jam situation as this ability reduces machine downtime and operator aggravation. Accordingly, the cutting/aligning assembly of the present invention is specifically designed to substantially reduce the potential for damage during a serious jam situation and also to allow convenient correction of such a situation.

More particularly, the present invention provides a cushioning conversion machine for converting stock material into cut sections of dunnage. Conversion assemblies, which are mounted to the machine's frame, convert the stock material into a continuous dunnage strip. A cutting/aligning assembly is mounted on the machine's frame downstream of an outlet opening through which the dunnage strip emerges.

The cutting/aligning assembly includes a moving blade unit which is mounted on the frame in such a manner that it travels between a rest position and a cutting position whereat it cuts the dunnage strip into a cut section. The cutting/aligning assembly also includes an automatic alignment device which automatically aligns the cut section with the dunnage outlet opening when the blade unit is moved from the cutting position to the rest position. The automatic alignment device is unattached to the moving blade unit yet travels therewith during jam-free operation of the cushioning conversion machine. In the preferred embodiment, the alignment device includes a transition surface which is aligned with a side of the dunnage outlet opening when the blade unit is in the rest position and the alignment device is biased into a sliding, but unattached, contact arrangement with the blade unit. If the machine includes a post-cutting constraining assembly, the automatic alignment device will automatically align the cut section with the constraining assembly's inlet when the blade unit is moved from the cutting position to the rest position.

The biased, but unattached, arrangement between the alignment device and the blade unit protects the machine from damage during a serious jam situation. Specifically, if the alignment device was not unattached to the moving blade unit (i.e., if it was attached to the blade unit), the alignment device would be forced into following the moving blade unit. However, with the cutting/aligning assembly of the present invention, this forced following is eliminated whereby the potential for such damage is substantially reduced.

The biased, but unattached, arrangement between the alignment device and the blade unit also allows a serious jam situation to be easily rectified. Particularly, the alignment device may be pulled away from a jammed pad. The jammed pad may then be pushed back into proper alignment and operation of the machine may be resumed. Thus, with the cutting/aligning assembly of the present invention, a serious jam situation may be corrected in a matter of minutes thereby reducing machine downtime and operator aggravation.

The present invention provides these and other features hereinafter fully described and particularly pointed out in the claims. The following description and annexed drawings set forth in detail a certain illustrative embodiment of the invention. This embodiment is indicative, however, of but one of the various ways in which the principles of the invention may be employed.

BRIEF DESCRIPTION OF THE DRAWINGS

In the annexed drawings:

FIGS. 5A–5D are schematic views of the cutting/aligning assembly, the post-cutting constraining assembly, and relevant portions of the machine frame, these views illustrating the interaction between these components during jam-free operation of the cushioning conversion machine; and FIGS. 6A–6B are schematic views of the cutting/aligning assembly, the post-cutting constraining assembly, and relevant portions of the machine frame, these views illustrating the interaction between these components during a serious jam situation.

DETAILED DESCRIPTION

Figure 1:
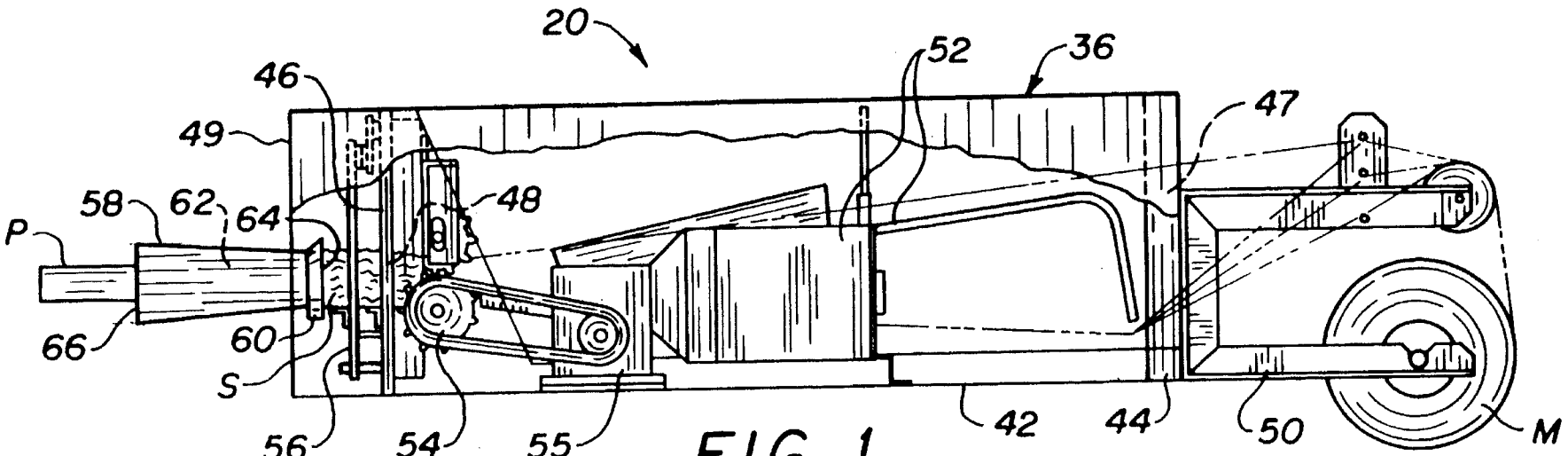
FIG. 1 is a side view of a cushioning conversion machine, the machine incorporating a cutting/aligning assembly according to the present invention.
Figure 2:
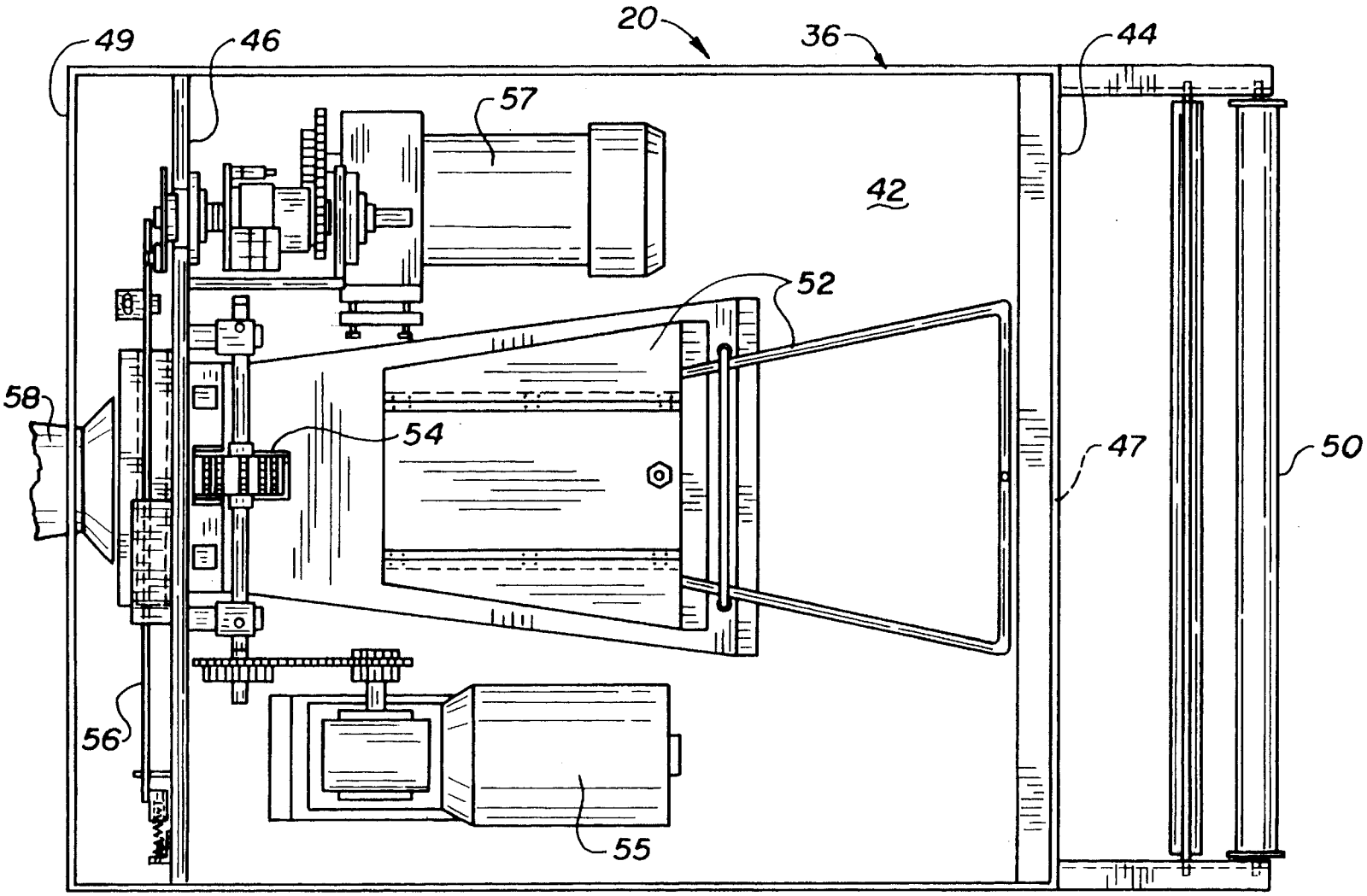
FIG. 2 is a top plan view of the cushioning conversion machine.

Referring now to the drawings in detail, and initially to FIGS. 1 and 2, a cushioning conversion machine 20 according to the present invention is illustrated. The machine 20 is shown positioned in a horizontal manner and loaded with a roll of sheet-like like stock material M. The stock material M preferably consists of three superimposed webs or layers of biodegradable, recyclable and reusable thirty-pound Kraft paper rolled onto a hollow cylindrical tube. The machine 20 converts the stock material M into a continuous unconnected strip having lateral pillow-like portions separated by a thin central band. This strip is connected or coined along its central band to form a coined dunnage strip S which is cut into sections, or pads, P of a desired length.

The machine's frame 36 includes a base plate 42 and two end plates 44 and 46. The frame base plate 42 is generally rectangular and, in the illustrated orientation, extends from its upstream end to its downstream end in a generally horizontal plane. (The terms "upstream" and "downstream" in this context are characteristic of the direction of flow of the stock material M through the machine 20.) While not specifically shown/numbered in the drawings, the frame 36 may also include lateral side plates and a top cover, which together with the base and end plates, form an enclosure.

The end plate 44 extends perpendicularly from the upstream edge of the frame base plate 42. Although not perfectly apparent from the illustrations, this upstream end plate 44 may be more specifically described as a thin rectangular border having a centrally located, and relatively large, rectangular stock inlet opening 47. The end plate 46 extends perpendicularly from a location near, but inward from, the downstream end of the frame base plate 42. The end plate 46 is generally rectangular and planar and includes a relatively small dunnage outlet opening 48. (The dunnage outlet opening 48 may be seen more clearly by briefly referring to FIGS. 3 and 4.)

The frame 36 also includes a back plate 49 which extends perpendicularly from the downstream edge of the frame base plate 42. Thus, the end plate 46 and the back plate 49 form part of a box-like extension on the downstream end of the frame 36. Preferably, the back plate 49 is a door-like structure which may be selectively opened to access certain components of the cushioning conversion machine 20.

The machine 20 further includes a stock supply assembly 50, a forming assembly 52, a gear assembly 54 powered by a gear motor 55, a cutting/aligning assembly 56 powered by a cutter motor 57, and a post-cutting constraining assembly 58. The stock supply assembly 50 is mounted to an upstream side of the first frame end plate 44. The forming assembly 52 is located downstream of the stock supply assembly 50 and is mounted on an intermediate portion of the frame base plate 42. The gear assembly 54 is located downstream of the forming assembly 52 and is mounted on an upstream side of the second frame end plate 46. On the opposite downstream side of the frame end plate 46, the cutting/aligning assembly 56 is mounted. The motors 55 and 57 are mounted on the frame base plate 42 on opposite sides of the forming assembly 52. The post-cutting constraining assembly 58 is located downstream of the cutting/aligning assembly 56 and it is mounted on the back plate 49.

In operation of the machine 20, the stock supply assembly 50 supplies the stock material M to the forming assembly 52. The forming assembly 52 causes inward rolling of the lateral edges of the sheet-like stock material M to form the lateral pillow-like portions of the continuous strip. The gear assembly 54 pulls the stock material 22 through the machine and also coins the central band to form the dunnage strip S. As the dunnage strip S travels downstream from the gear assembly 54, the cutting/aligning assembly 56 cuts the dunnage strip S into sections, or pads, P of a desired length. The cut pads P then travel through the post-cutting constraining assembly 58. As is explained in more detail below, the cutting/aligning assembly 56 insures correct alignment of a cut pad P with the dunnage outlet opening 48 and/or the inlet of the post-cutting constraining assembly 58.

The post-cutting constraining assembly 58 includes an upstream converging portion 60 and a downstream tunnel portion 62. The converging portion 60 is located between the downstream end plate 46 and the back plate 49, while the tunnel portion 62 extends through and beyond the back plate 49. The upstream converging portion 60 preferably forms a "three-sided" rectangular border with the bottom side (in the illustrated orientation) being omitted. In any event, the upstream converging portion 60 tapers into the downstream tunnel portion 62 and the downstream tunnel portion 62 flares slightly outward towards its downstream end.

The post-cutting constraining assembly 58 is positioned so that its inlet 64 is aligned with the dunnage outlet opening 48 of the end plate 46. The downstream outlet 66 of the post-cutting constraining assembly 58 is also preferably aligned with the dunnage outlet opening 48 of the end plate 46 and also with the inlet 64 of the post-cutting constraining assembly 58.

A cut pad P will be urged or pushed downstream through the post-cutting constraining assembly 58 by the approaching dunnage strip S. The converging portion 60 smoothly urges the pad P into the tunnel portion 62. As the pad P passes through the tunnel portion 62, it is generally constrained circumferentially. When the pad P emerges from the post-cutting constraining assembly 58, the conversion of the stock material M is complete.

Figure 3:
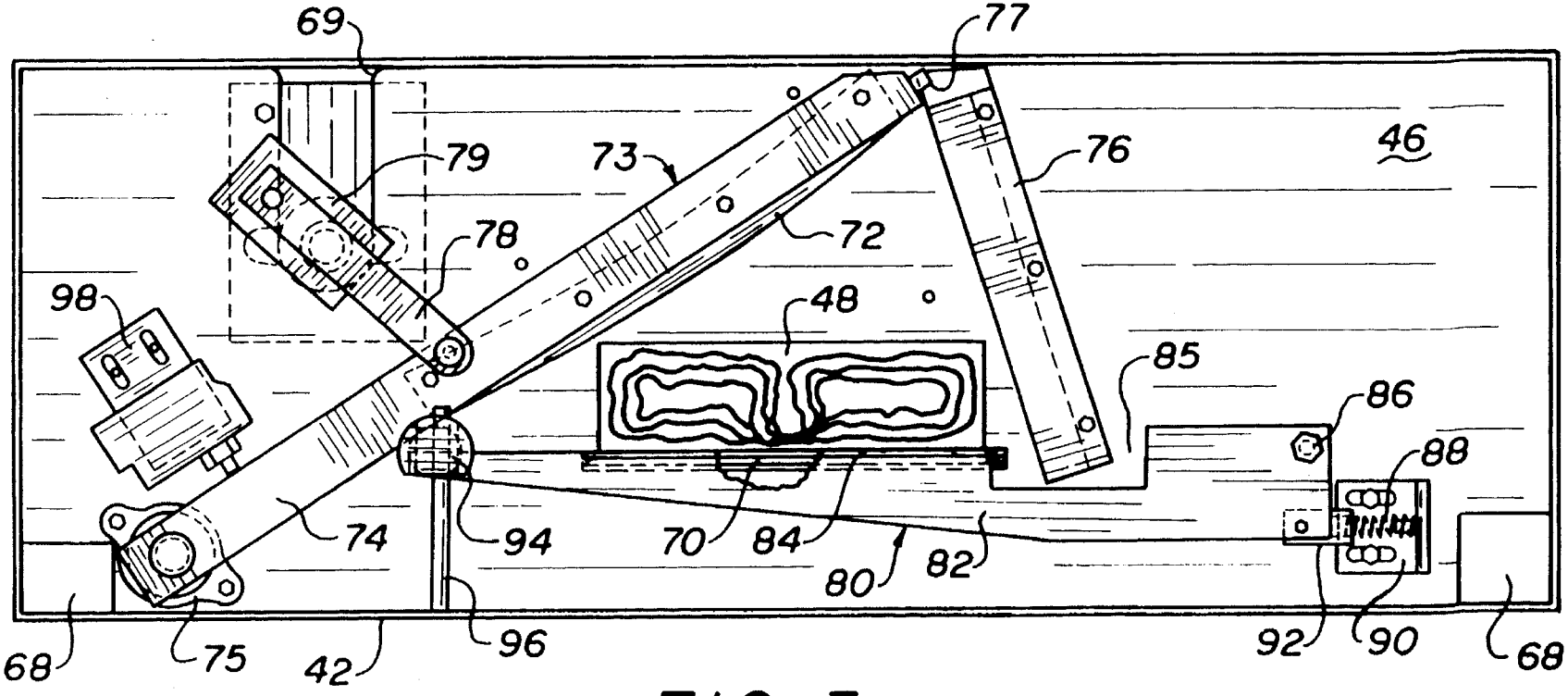
FIG. 3 is an isolated end view of the cutting/aligning assembly and relevant portions of the machine's frame, the cutting/aligning assembly being shown in a rest position.
Figure 4:
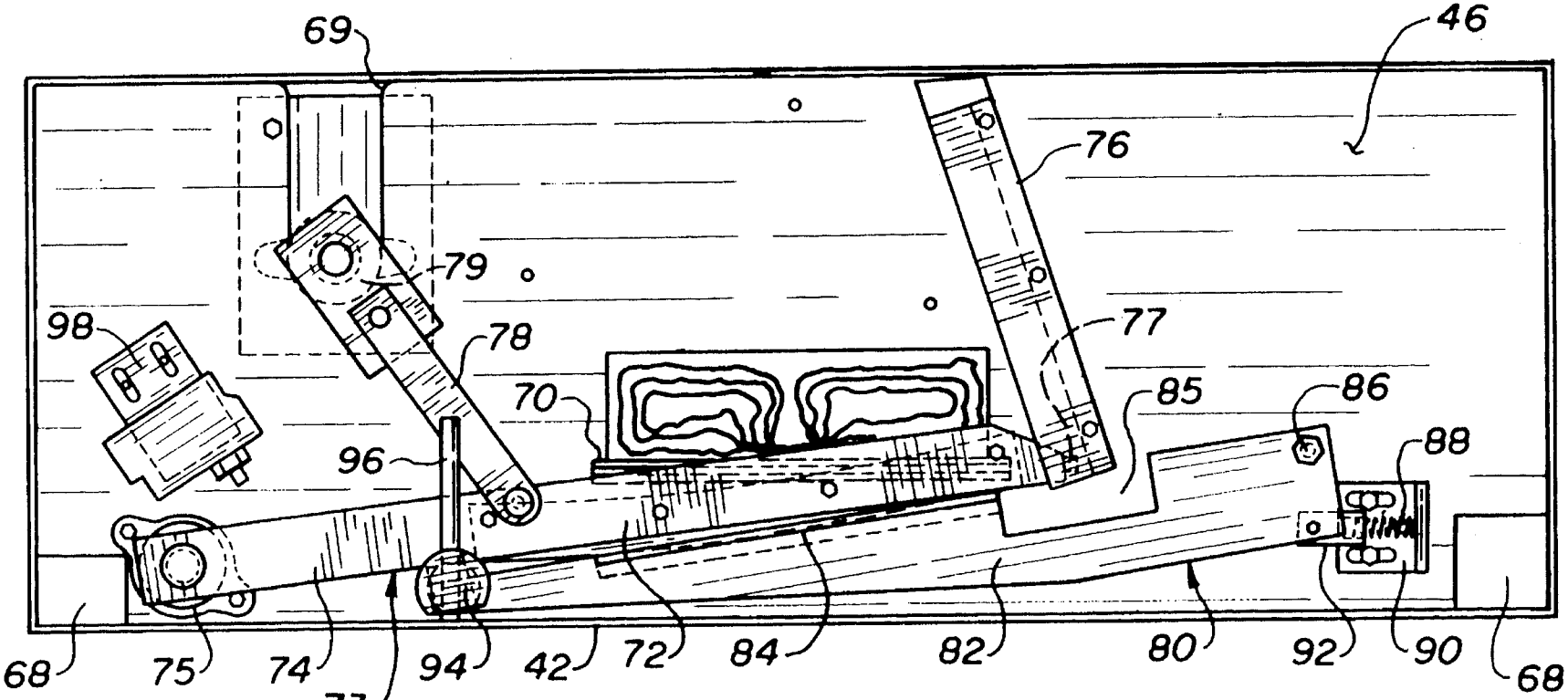
FIG. 4 is a view similar to FIG. 3 except that the cutting/aligning assembly is shown in a cutting position.

Details of the cutting/aligning assembly 56 and the frame end plate 46 may be seen in FIGS. 3 and 4 where these components are illustrated isolated from the rest of the machine 20. As shown, the roughly rectangular end plate 46 has two square notches 68 on its proximal comers and an offset open slot 69 on its distal side. (The terms "proximal" and "distal" in this context refer to the location of the end plate 46 relative to the frame base plate 42.) The notches 68 coordinate with the frame base plate 42 for attachment purposes and the slot 69 accommodates the shaft of the cutter motor 57.

The cutting/aligning assembly 56 includes a stationary blade 70 and a moving blade 72, both of which are strategically positioned relative to the dunnage outlet opening 48. The blades 70 and 72 are the actual "cutting" elements of the cutting/aligning assembly 56 and coact in a scissor-like fashion to cut the dunnage strip S into cut sections, or pads, P. The stationary blade 70 is fixedly mounted on the frame end plate 46 in such a manner that it is aligned with the proximal side of the dunnage outlet opening 48. (Again, the terms "proximal" and "distal" in this context refer to the location of the dunnage outlet opening 48 relative to the frame base plate 42.) The moving blade 72 is part of a moving blade unit 73 which includes a blade support member 74 on which the moving blade 72 is mounted. One end of the blade support member 74 is pivotally attached to the end plate 46 by, for example, a bearing block 75. The other end of the blade support member 74 is slidably mounted on the end plate 46 within a slanted guide track 76. As is best seen by comparing FIGS. 3 and 4, this end of the blade support member 74 travels back-and-forth within the guide track 76 during a cutting cycle. Preferably, a roller 77 is attached to the appropriate end of the blade support member 74 to facilitate its travel within the guide track 76.

An intermediate (but not exactly central) part of the blade support member 74 is connected to a drive link 78 which is connected to a drive hub 79. A shaft (shown but not specifically numbered) is connected at one end to the drive hub 79. The shaft extends from the downstream side of the end plate 46 and through the open offset slot 69 to the upstream side of the plate 46. The opposite end of the shaft is operably connected to the cutter motor 57.

During operation of the cutting/aligning assembly 56, the drive hub 79 is rotated so that the moving blade unit 73 travels between a rest position and a cutting position. Particularly, the position of the drive link 78 is varied to move the blade unit 73 within the guide track 76 at a desired interval. More particularly, as the drive hub 79 is rotated 180° in the appropriate direction (clockwise in the illustrated embodiment), the moving blade unit 73 makes a cutting stroke through the dunnage strip S. As the drive hub 79 continues its rotation for another 180°, the moving blade unit 73 makes a return stroke to the rest position.

The cutting/aligning assembly 56 additionally includes an alignment device 80 which automatically "re-aligns" the cut section, or pad P, with the dunnage outlet opening 48 and the post-cutting constraining assembly 58 during the return stroke of the moving blade unit 73. As is explained in more detail below, the automatic alignment device 80 is unattached to the moving blade unit 73 but travels therewith during jam-free operation of the cushioning conversion machine 20. As is also explained in more detail below, the "unattached" nature of the alignment device 80 is particularly advantageous in the unlikely event of a serious jam in the machine 20.

The preferred alignment device 80 includes a support member 82 and a transition surface 84. The alignment support member 82 is in the form of a panel which is orientated parallel to the end plate 46 and which includes a notch 85 for accommodating the guide track 76. One end of the alignment support member 82 (the end closest to the guide track 76) is pivotally attached to the end plate 46 via a suitable fastener, such as a shoulder bolt 86. The transition surface 84 is in the form of a shelf which is attached to, and which extends perpendicularly downstream from, the alignment support member 82. As will soon become more apparent, the alignment transition surface 84 will be aligned with the proximate side of the dunnage outlet opening 48 when the cutting/aligning assembly 56 is in the rest position during jam-free operation.

The alignment support member 82 is specifically designed to be unattached to the moving blade unit 73 but is also specifically designed to travel therewith during jam-free operation of the machine 20. These design objectives are preferably accomplished by biasing the alignment support member 82 into a sliding (but unattached) contact arrangement with the moving blade unit 73.

In the preferred embodiment of the invention, biasing is accomplished by a spring 88. The spring 88, which is mounted to the end plate 46 via a bracket 90, cooperates with a spring-engaging member 92 attached to the pivotally mounted end of the alignment support member 82. The compression characteristics of the spring 88 are such that the alignment support member 80 will remain in biased contact with the moving blade unit 73 throughout a jam-free cutting cycle yet will allow selective disassociation therefrom with a minimum amount of force in a jam situation.

Also in the preferred embodiment of the invention, sliding contact is accomplished by the cooperation between a follower 94 and a guide rod 96. The follower 94 is attached to the appropriate end of the alignment support member 82 (the end opposite the pivotally mounted end). The guide rod 96 is attached to the frame base plate 42 and extends outwardly therefrom adjacent upstream side of the end plate 46. The follower 94 includes a suitable slot (shown but not specifically numbered) which straddles the edge of the blade support member 74 and a bore (shown but not specifically numbered) which receives the guide rod 96 in a reciprocating arrangement. As is best seen by comparing FIGS. 3 and 4, the follower 94 slides along the blade support member 74 and also along the length of the guide rod 96 during a jam-free cutting cycle.

The interaction between the cutting/aligning assembly 56 and the post-cutting constraining assembly 58 during jam-free operation of the machine 20 is best explained by referring additionally to FIGS. 5A–5D. In the rest position shown in FIG. 5A, the moving blade unit 73 completely clears the dunnage outlet opening 48 and the alignment device's transition surface 84 is aligned with the proximal side of the dunnage outlet opening 48. Additionally, the alignment follower 94 is spring biased into contact with, and cradles the contacted edge of, the blade support member 74. Also, the alignment follower 94 is situated adjacent to the distal end of the guide rod 96. (See FIG. 5A1.) As shown in FIG. 5A2, the dunnage strip S travels through the dunnage outlet opening 48, over the transition surface 84 and into the post-cutting constraining assembly 58.

At the desired interval, the moving blade unit 73 is moved the appropriate direction (which is downward in the illustrated orientation) within the guide track 76 to the cutting position. During this movement, the alignment device's follower 94 slides along the edge of the blade support member 74 and it also travels towards the proximate end of the guide rod 96. (See FIG. 5B 1.) In this cutting position, the moving blade 72 coacts with the stationary blade 70 and the alignment device's transition surface 84 is located remote from the dunnage outlet opening 48. (See FIG. 5B2.) In this manner, the leading end of the dunnage strip S is cut into a cut section, or pad, P. As shown, the action of the moving blade unit 73 also sometimes tends to misalign the pad P relative to the dunnage outlet opening 48 and/or the post-cutting constraining assembly 58.

The moving blade unit 73 is then moved in the opposite direction towards the rest position. During this movement, the alignment device's follower 94 continues to cradle, and continues to slide along, the edge of the blade support member 74 and it also travels towards the distal end of the guide rod 96. (See FIG. 5C1.) Usually, the mere movement of the blade unit 73 in this direction will result in the pad P "rebounding" back into alignment with the dunnage outlet opening 48 and/or the post-cutting constraining assembly 58. However, as shown in FIG. 5C2, the pad P sometimes remains at least partially misaligned even after this movement of the blade unit 73.

Once the moving blade unit 73 reaches the rest position, it once again completely clears the dunnage outlet opening 48. Also, quite significantly, the alignment transition surface 84 is once again aligned with the proximal side of the dunnage outlet opening 48. (See FIG. 5D1.) Thus, the movement of the transition surface 84 during the return stroke of the cutting/aligning assembly 56 automatically "re-aligns" the pad P with the dunnage outlet opening 48 and the post-cutting constraining assembly 58. (See FIG. 5D2.) In other words, the alignment device 80 insures a smooth transition for the pad P from the dunnage outlet opening 48 into the post-cutting constraining assembly 58. In this manner, the cut pad P steadily continues its downstream travel as it is pushed by the approaching dunnage strip S.

Referring now to FIGS. 6A and 6B, the interaction between the cutting/aligning assembly 56 and the post-cutting constraining assembly 58 during a serious jam of the cushioning conversion machine 20 is schematically illustrated. As shown in FIGS. 6A1 and 6A2, a jammed pad P* may prevent the alignment device 80 from following the return motion of the moving blade unit 73. Significantly, if the alignment device 80 was not unattached to the moving blade unit 73 (i.e., if it was attached to the blade unit 73), the alignment device 80 would be forced into following the moving blade unit 73. Specifically, because the cutter motor 57 will continue to exert power in an effort to complete the cutting cycle, such a forced following increases the chance of damage to the cutting/aligning assembly 56 during a serious jam situation. However, because the alignment device 80 of the present invention is unattached to the moving blade unit 73, the potential for such damage is substantially reduced.

Also, as is shown in FIG. 6B, the unattached arrangement between the alignment device 80 and the moving blade unit 73 allows a serious jam situation to be easily rectified. Particularly, the alignment device 80 may be pulled away from the jammed pad P*. (As was indicated above, the compression characteristics of the spring 88 are such that selective disassociation is possible with a minimum amount of force in a jam situation.) The jammed pad P* may then be pushed back into proper alignment with the post-cutting constraining assembly 58 and operation of the machine 20 may be resumed. Thus, with the cutting/aligning assembly 56 of the present invention, a serious jam situation may be corrected in a matter of minutes thereby reducing machine downtime and operator aggravation.

The cutting/aligning assembly 56 may further include a miscut detection circuit which detects a failure to complete a cutting cycle within a prescribed period of time and which interrupts electrical power to the cutter motor 57 to protect it and other components of the machine 20. Such a miscut detection circuit could include a blade switch mechanism 98 mounted to the frame end plate 48. (See FIGS. 3 and 4.) The preferred miscut detection circuit is disclosed in detail in U.S. application Ser. No. 08/156,365 to Simmons which was filed on Nov. 23, 1993 and which is entitled "Cutting Assembly Including a Miscut Detection Circuit." This application is assigned to the assignee of the present application and its entire disclosure is hereby incorporated by reference.

One may now appreciate that the present invention provides a cutting/aligning assembly which automatically "re-aligns" a cut section of dunnage with a dunnage outlet opening and with a post-cutting constraining assembly during the return stroke of a moving blade unit. Although the invention has been shown and described with respect to a certain preferred embodiment, it is obvious that equivalent alterations and modifications will occur to others skilled in the an upon the reading and understanding of this specification. The present invention includes all such equivalent alterations and modifications, and is limited only by the scope of the following claims.

What is claimed is:

1. A cushioning conversion machine for converting stock material into a cut section of dunnage, the machine comprising a frame, conversion assemblies, and a cutting/alignment assembly;

the conversion assemblies being positioned upstream of the cutting/alignment assembly and converting the stock material into a dunnage strip;

the frame having a dunnage outlet opening through which the dunnage strip emerges;

the cutting/alignment assembly being mounted on the frame adjacent the outlet opening and including a blade unit and an automatic alignment device;

the blade unit traveling between a rest position and a cutting position whereby it cuts the dunnage strip into a cut section of dunnage;

the automatic alignment device automatically aligning the cut section with the outlet opening as the blade unit is moved from the cutting position to the rest position; and the automatic alignment device being unattached to the blade unit yet traveling therewith as the blade travels between the rest position and the cutting position during jam-free operation of the cushioning conversion machine.

2. A cushioning conversion machine as set forth in claim 1 wherein the alignment device includes a transition surface which is aligned with a side of the dunnage outlet opening when the moving blade unit is in the rest position.

3. A cushioning conversion machine for converting stock material into a cut section of dunnage, the machine comprising a frame, conversion assemblies, and a cutting/alignment assembly;

the conversion assemblies being mounted on the frame and converting the stock material into a dunnage strip;

the frame having a dunnage outlet opening through which the dunnage strip emerges;

the cutting/alignment assembly being mounted on the frame downstream of the outlet opening and including a blade unit and an automatic alignment device;

the blade unit being mounted on the frame in such a manner that it travels between a rest position and a cutting position whereby it cuts the dunnage strip into a cut section of dunnage;

the automatic alignment device automatically aligning the cut section with the outlet opening when the blade unit is moved from the cutting position to the rest position; and the automatic alignment device being unattached to the blade unit yet traveling therewith during jam-free operation of the cushioning conversion machine;

wherein the alignment device is biased into a sliding, but unattached, contact arrangement with the blade unit.

4. A cushioning conversion machine as set forth in claim 3 wherein the alignment device includes a transition surface which is aligned with a side of the dunnage outlet opening when the moving blade unit is in the rest position.

5. A cushioning conversion machine as set forth in claim 4 wherein the alignment device is spring biased.

6. A cushioning conversion machine as set forth in claim 5 wherein the compression characteristics of the spring are such that the alignment device will remain in biased contact with the blade unit throughout a jam-free cutting cycle while at the same time will allow selective disassociation therefrom in a jam situation.

7. A cushioning conversion machine as set forth in claim 4 wherein the cutting/aligning assembly further includes a second blade which coacts with the moving blade unit when it is in the cutting position.

8. A cushioning conversion machine as set forth in claim 7 wherein the second blade is fixedly mounted to the machine frame adjacent to the dunnage outlet opening.

9. A cushioning conversion machine as set forth in claim 8 wherein the moving blade unit coacts with the second blade member in a scissor-like fashion.

10. A cushioning conversion machine as set forth in claim 3 wherein the alignment device includes an alignment support member which is pivotally attached to the machine's frame and wherein the transition surface is attached to the alignment support member.

11. A cushioning conversion machine as set forth in claim 10 wherein the transition surface is in the form of a shelf which is attached to, and which extends perpendicularly downstream from, the alignment support member.

12. A cushioning conversion machine as set forth in claim 11 wherein the alignment device includes a follower and a guide rod;

wherein the follower is coupled to the alignment support member and remains in sliding contact with the blade unit during jam-free operation of the machine;

wherein the guide rod is attached to the machine frame and is received by the follower in a reciprocating arrangement.

13. A method of making a cut section of dunnage, said method comprising the steps of supplying a stock material and using the machine of either claim 1 or claim 3 to convert the stock material into a cut section of dunnage.

14. A method as set forth in claim 13 wherein the stock material is biodegradable, recyclable, and reusable.

15. A method as set forth in claim 13 wherein the stock material is Kraft paper.

16. A method as set forth in claim 13 wherein the stock material comprises multiple plies of Kraft paper.

17. A method as set forth in claim 13 wherein the stock material comprises a roll of three superimposed plies of Kraft paper.

18. A cushioning conversion machine as set forth in any of claims 1–3 further comprising a post-cutting constraining assembly which is mounted on the frame downstream of the cutting/aligning assembly and which circumferentially constrains the cut sections.

19. A cushioning conversion machine as set forth in claim 18 wherein the post-cutting constraining assembly includes an inlet which is aligned with the dunnage outlet opening whereby the automatic alignment device automatically aligns the cut section with this inlet when the blade unit is moved from the cutting position to the rest position.

20. A cushioning conversion machine as set forth in claim 1 wherein the conversion assemblies include:

a forming assembly which causes inward rolling of the lateral edges of the sheet-like material into a generally spiral-like form whereby a strip having two lateral pillow-like portions separated by a thin central band is formed;

a stock supply assembly which supplies the stock material to the forming assembly; and a pulling/connecting assembly which pulls the stock material from the stock supply assembly and through the forming assembly to form the strip and which connects the strip along its central band whereby a coined dunnage strip is formed.

* * * * *